United States Patent [19]

Conaway

[11] 4,238,667

[45] Dec. 9, 1980

[54] HEATING UNIT FOR HIP FURNACE

[75] Inventor: Robert M. Conaway, Columbus, Ohio

[73] Assignee: Conaway Pressure Systems, Inc., Dublin, Ohio

[21] Appl. No.: 4,187

[22] Filed: Jan. 17, 1979

[51] Int. Cl.[3] ..... H05B 3/06

[52] U.S. Cl. ..... 219/390; 13/25; 219/407; 219/424; 425/405 H; 338/316

[58] Field of Search ..... 219/390, 406, 407, 398, 219/424, 380, 381; 338/315, 316, 318, 290, 283, 294; 13/25, 31 R

[56] References Cited

U.S. PATENT DOCUMENTS

| | | | |
|---|---|---|---|
| 1,861,947 | 6/1932 | Woodson et al. | 13/25 |
| 1,915,747 | 6/1933 | Moore | 13/25 |
| 1,923,644 | 8/1933 | Simpson | 13/25 |
| 3,161,756 | 12/1964 | Haverkamp et al. | 219/424 |
| 3,202,750 | 8/1965 | Malm et al. | 13/25 |
| 3,427,011 | 2/1969 | Boyer et al. | 13/31 |
| 4,126,757 | 11/1978 | Smith, Jr. et al. | 13/25 |

*Primary Examiner*—B. A. Reynolds
*Assistant Examiner*—Bernard Roskoski
*Attorney, Agent, or Firm*—Burns, Doane, Swecker & Mathis

[57] ABSTRACT

A furnace for heating work material comprises an outer wall defining a space therein. A first upright cylindrical shell is disposed within the space and defines a work chamber for receiving work material to be heated. A second upright cylindrical shell surrounds and is spaced outwardly of the first shell to form a heater space therebetween. A heater assembly comprises support pins disposed across and supported atop the first and second shells. A generally vertically extending electrical heating element is supported from the support means, is disposed within the heating space, and extends around at least a portion of the periphery of the first shell. The heating element is unconstrained against free thermal expansion and contraction in vertical directions relative to the first and second shells.

19 Claims, 7 Drawing Figures

Fig. 3
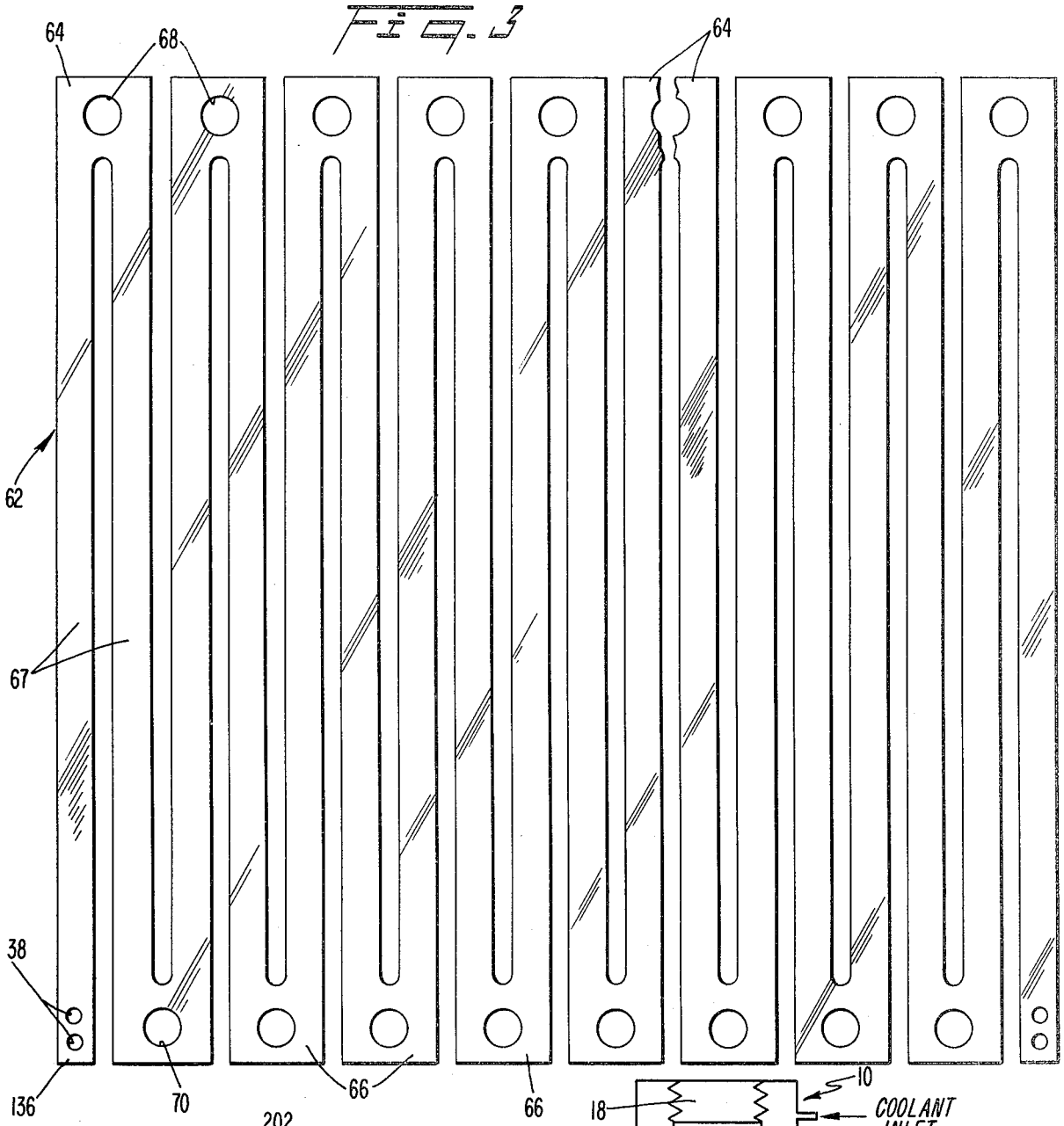
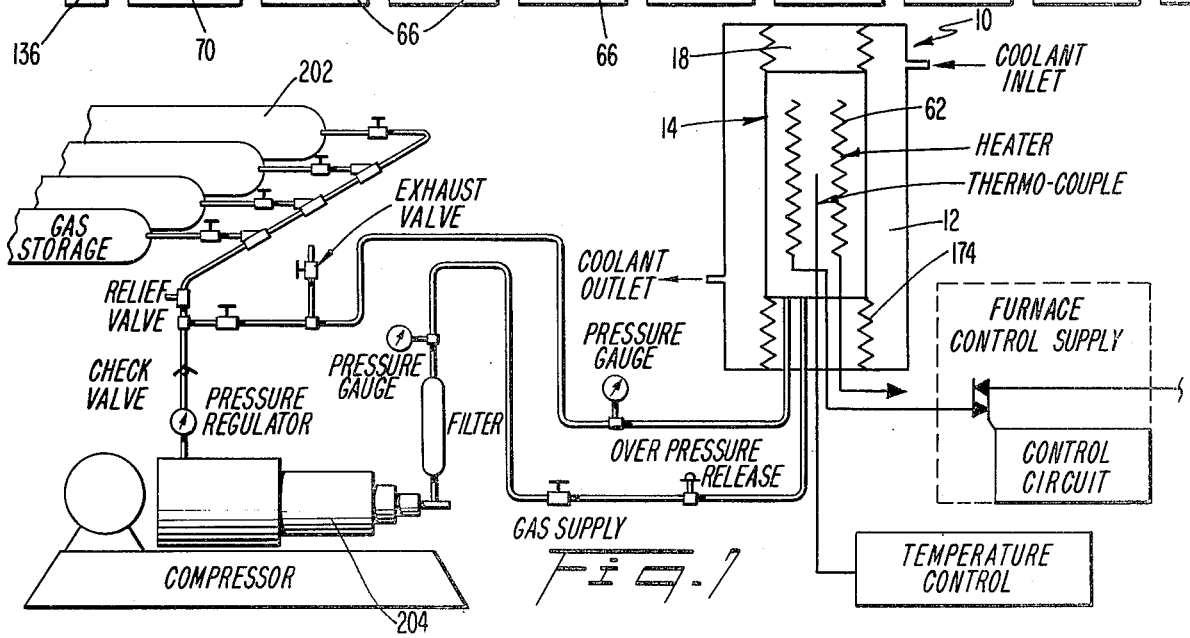
Fig. 7

HEATING UNIT FOR HIP FURNACE

BACKGROUND AND OBJECTS OF THE INVENTION

The present invention relates to heating systems for furnaces which heat work material and especially, but not limited to, high pressure furnaces commonly refered to as hot isostatic pressure (HIP) furnaces.

Among the types of furnaces which heat work material is the so-called hot isostatic pressure furnace which will be referred to hereafter as a high pressure furnace to distinguish over furnaces which do not require a heavy duty outer pressure vessel, although the present invention is not limited to use with the latter type, as will be made apparent hereinafter.

Conventional hot isostatic pressure furnaces provide an enclosed work chamber and maintain within the chamber pressures and temperatures sufficient to effect solid state bonding of materials.

Such high pressure furnaces generally comprise a heavy duty outer pressure wall and a removable furnace assembly located therein. The furnace assembly includes a thermal barrier surrounding an inner shell, the latter defining the work chamber and usually carrying a heat-generating system. A pressure medium, for example inert gases like helium or argon, is conducted through the outer pressure wall and eventually to the work chamber to raise the pressure to high levels therein. Simultaneously, the temperature is raised by the heating system. The high pressure forces mating surfaces of the work materials into intimate contact for a sufficient time to cause solid state bonding.

A high pressure furnace can be used to bond metallic, cermet, and ceramic powders or preforms, among other materials, into fully dense structures.

High pressure furnaces are exemplified by that disclosed in U.S. Pat. No. 3,427,011 issued to Boyer et al on Feb. 11, 1969. While the high pressure furnace described in that patent has proven to be highly useful, substantial room for improvement remains.

One of the significant factors encountered in the design of a furnace of the type which heats work materials relates to the size of the volumes to be heated and/or pressurized. In the design of such a furnace, a work space of a certain minimal volume is usually required. Additional space, i.e., non-critical space, is unnecessary from a heating (and/or pressurizing) performance standpoint but may be necessary as a practical matter for containing various components of the actuating mechanism, such as the heating system. However, the presence of such additional space maximizes overall energy demands in order to achieve the desired temperature and/or pressure within the work space, as well as maximizing the overall size of the structure, including the outer confining wall. For this reason, it would be highly desirable to minimize the excess space surrounding the work space.

As noted above, among the components which create excess space is the heating system. In this regard, it has been heretofore proposed, in the above mentioned Boyer et al patent for example, to wind an electrical heating wire in vertical serpentine manner around vertically spaced insulators which are connected in cantilever fashion to the outer side of the shell that defines the work chamber. Such an arrangement necessitates the use of a relatively sturdy (and thus relatively thick-walled) shell. Moreover, the insulators require fasteners, washers etc. which further enlarge the diametrical dimension. Moreover, thick-walled shells are costly to fabricate because of difficulties experienced in rolling metal of such thicknesses.

Another area where improvements can be made to furnaces of the type which heat work materials, involves the time and effort required for assembly and dissassembly of the heating system. In systems of the type described in the above-captioned Boyer et al patent, a plurality of insulator members are individually secured to the outer wall of the chamber defining shell, around which elements a heating wire is to be wound. The need for fastening each insulating member in place involves considerable time and labor. Moreover, it will be appreciated that considerable difficulty is involved in thereafter obtaining access to the heating element and insulator members for maintenance or replacement purposes.

An additional area of concern in the design of such furnaces relates to the normal tendency for thermal expansion and/or contraction of the heating element to occur. One previous manner of dealing with this problem involves the provision of a relatively loose mounting of the heating wire on the insulator members. Such an arrangement is intended to accommodate expansion and contraction of the wire. However, in practice, it can be rather difficult to achieve an optimum amount of "looseness" of the wire to assure that the wire is loose enough to prevent excessive tensioning of the wire on the insulator members when the wire is contracted, and yet is not so loose as to lose contact with the insulator members and short circuit against the chamber-defining shell.

It is, therefore, an object of the present invention to minimize or obviate problems of the type discussed above.

It is another object of the invention to provide a novel heating system for a furnace of the type which heats work material, especially, but not limited to, high pressure furnaces.

It is a further object of the invention to minimize non-critical space within such furnaces.

It is another object of the invention to simplify the installation and removal of a heating system for such furnaces.

It is additional object of the invention to accommodate unconstrained thermal expansion and contraction of a furnace electrical heating element without the danger of short circuiting.

It is another object of the invention to minimize the power requirements of such a furnace as well as to simplify the maintenance of the heating system thereof.

BRIEF SUMMARY OF THE INVENTION

These and other objects are achieved by the present invention which involves a furnace of the type for heating work material. The furnace comprises an outer wall which defines a space therein. A first upright cylindrical shell is disposed within the space and defines a work chamber for receiving work material to be heated. A second upright cylindrical shell surrounds the first shell and is spaced outwardly thereof to form a heater space therebetween. A heater system is provided which comprises support members disposed across and supported atop the first and second shells. A generally vertically extending electrical heating element is supported from the support members and is disposed within the heating space. The heating element extends around at least a portion of the periphery of the first shell and is unconstrained against free thermal expansion and contraction in vertical directions relative to the first and second shells.

Preferably, the heating element is of vertically serpentine configuration, having upper and lower bight portions. The upper bight portions are connected to support pins and the lower bight portions carry spacer pins.

BREIF DESCRIPTION OF THE DRAWING

The advantages of the present invention will become apparent from the following detailed description of a preferred embodiment thereof in connection with the accompanying drawings in which like numerals designate like elements and in which:

FIG. 3 is a side elevational view of a heating element according to the present invention;

FIG. 7 is a schematic representation of a pressurizing and heating system for the high pressure furnace.

DETAILED DESCRIPTION OF A PREFERRED EMBODIMENT OF THE INVENTION

Figure 1:
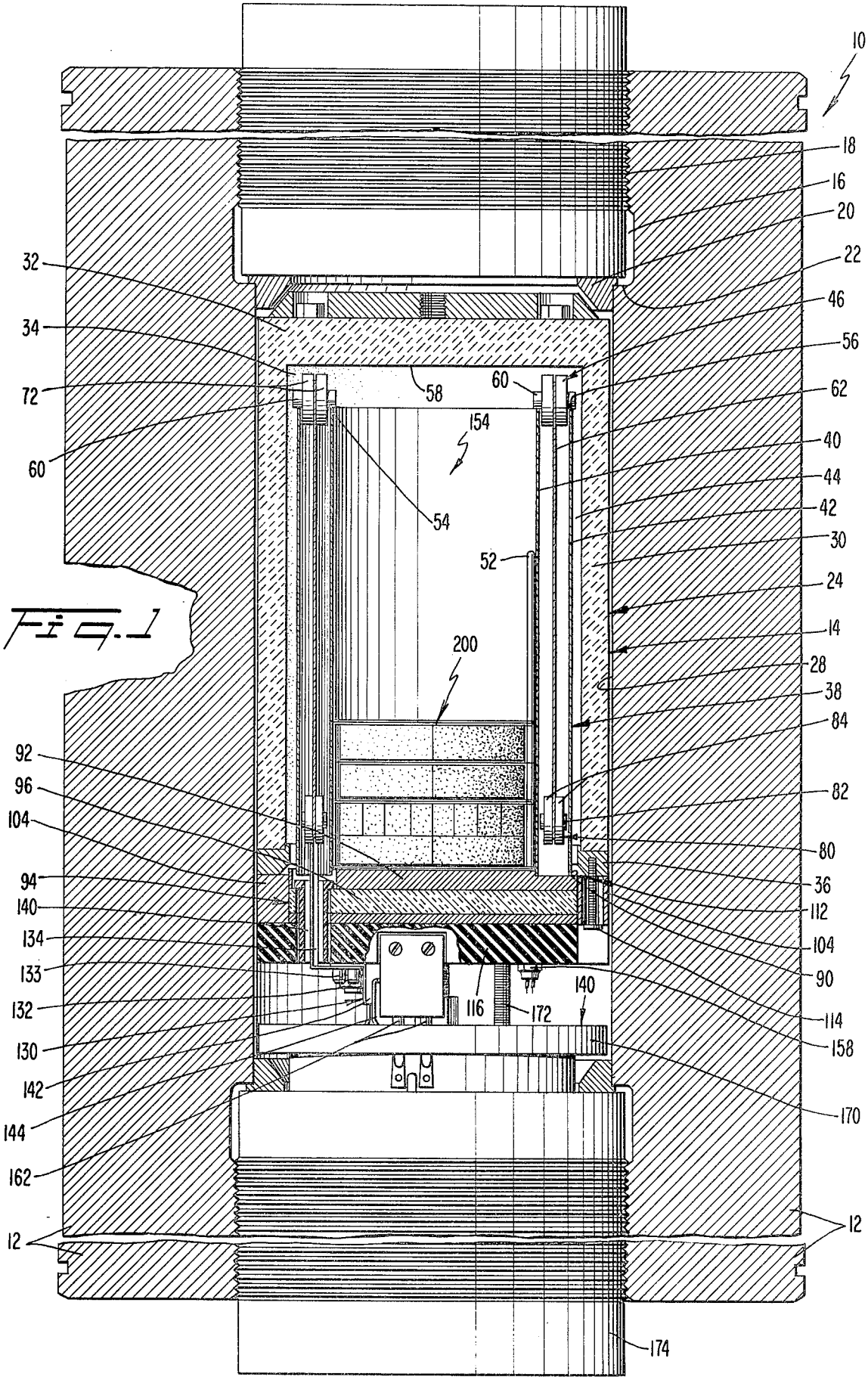
FIG. 1 is a vertical longitudinal sectional view of a high pressure furnace according to the present invention.
Figure 2:
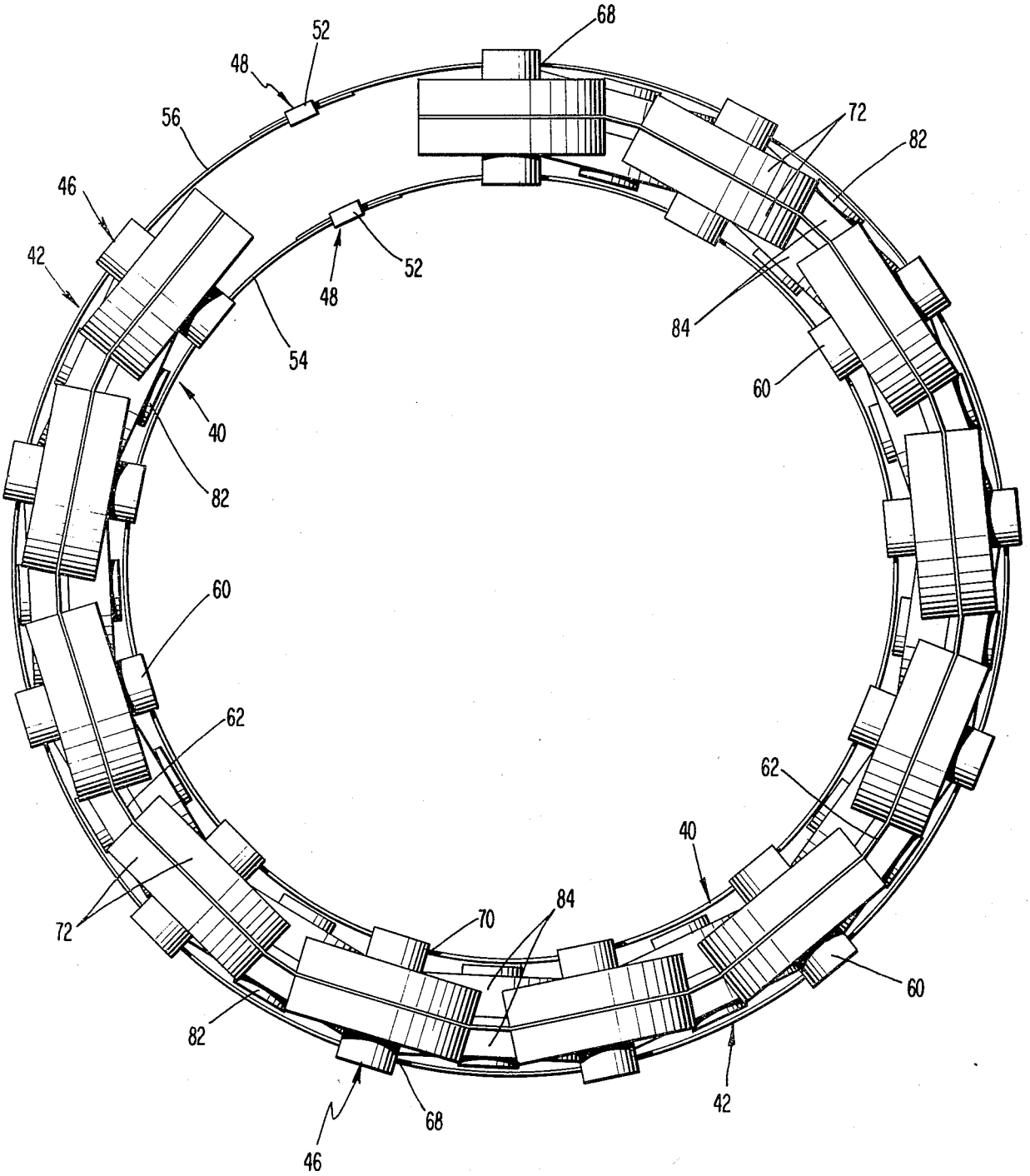
FIG. 2 is a plan view of a heater module according to the present invention.

A preferred furnace apparatus in accordance with the present invention comprises a high pressure furnace generally referred to as a hot isostatic pressure furnace 10.

The high pressure furnace 10 comprises an outer pressure wall 12 in the form of a heavy duty cylindrical outer pressure vessel, preferably of circular cross-section. The wall 12 encloses a space for reception of a furnace assembly 14 which comprises a thermal barrier 24 and a heating module 38. The furnace assembly 14 is of the removable type and is inserted or removed via an opening 16 at the top of the pressure wall 12. The opening 16 is opened and closed by means of an externally threaded top closure 18 which is threadedly connectible with an internal threading on the pressure wall 12.

The wall 12 itself contains fluid conducting passages for conducting a suitable coolant medium.

A seal ring 20 is mounted upon a shoulder 22 on the pressure wall 12, against which the top closure 18 can be firmly engaged to establish a pressure tight seal.

The furnace assembly 14 includes an outer wall in the form of a main thermal barrier or sheath portion 24 whose outer surface 26 is spaced radially inwardly of the inner surface 28 of the pressure wall 12. The thermal barrier comprises a cylindrical side portion 30 and a circular top portion 32 which extend around a furnace space 34. The thermal barrier functions to minimize heat loss from the furnace space while allowing pressure medium to be conducted thereto.

It will be understood that the pressure wall 12, top closure 18, seal ring 20, and thermal barrier can be of conventional design, such as that disclosed in the aforementioned U.S. Pat. No. 3,427,011 of Boyer et al, the disclosure of which is hereby incorporated by reference as if set forth at length herein.

The thermal barrier 24 rests on a support ring 36 which is supported in a manner to be discussed.

In accordance with the present invention a heating module 38 is positioned within the furnace space 34. The heating module 38 comprises a cylindrical, upright inner shell 40, a cylindrical, upright outer shell 42 spaced radially outwardly from the inner shell 40 to form a heater space 44 therebetween, and a heating unit 46 disposed between the inner and outer shells 40, 42.

Figure 4:
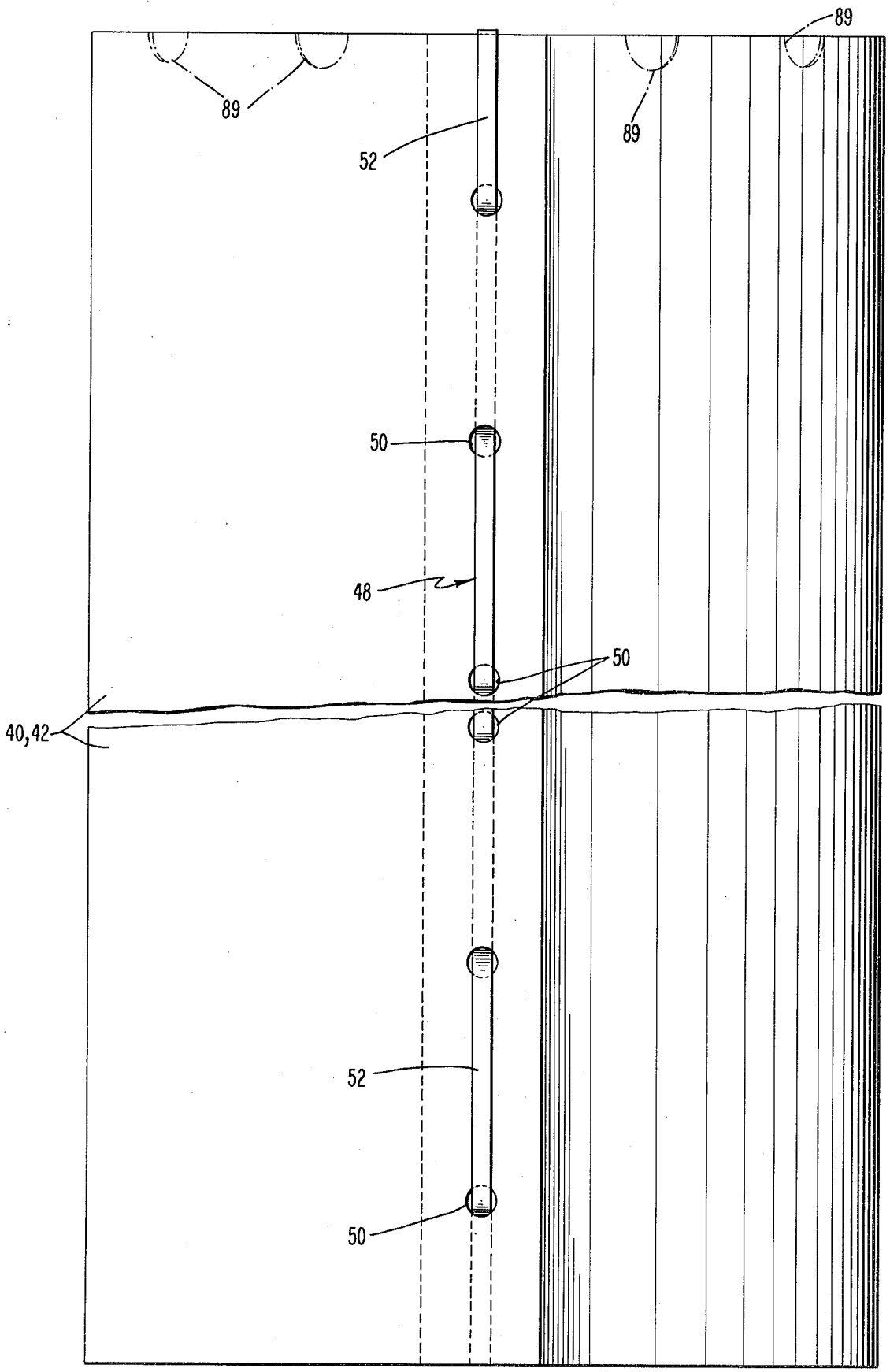
FIG. 4 is a side elevational view of a shell according to the present invention, depicting the manner of connecting the shell ends together.

The inner and outer shells 40, 42 are formed of thin sheet metal, preferably tungsten, which is rolled into cylindrical shape. Preferably, tungsten sheeting is employed which is of 10 mil. thickness and thus capable of being inexpensively hand-rolled and secured by means of a coupling comprising an upright rod 48 (FIG. 4). In this regard, each tungsten sheet is formed at both ends with holes 50 which are aligned when the sheet has been rolled. This enables the rod 48 to be inserted successively through the pairs of aligned holes. The sheet metal is thin enough to be flexed sufficiently to accommodate insertion of the rod. The rod 48 includes a hook-like projection 52 at the upper end which serves as a stop.

The inner and outer shells 40, 42 each include an upper edge 54, 56 which is spaced a small distance beneath the underside 58 of the top portion 32 of the thermal barrier.

The heater unit 46 is supported on the upper edges 54, 56 and includes a plurality of support pins 60 which are oriented radially with reference to the vertical longitudinal axis of the shells 40, 42 and are spaced circumferentially from one another around the edges 54, 56.

Each pin 60 extends across both shells 40, 42 and rests freely on the edges 54, 56 in the sense that it is not fastened to either of the shells 40, 42. The pins 60 are formed of an electrically insulative material, such as alumina or yttria, for example. The pins 60 are cylindrical in shape and preferably circular in cross-section, although cylindrical pins of other cross-sectional shape can be utilized.

Mounted on the pins 60 is a heating element in the form of a one-piece strip 62 of electrically conductive material, preferably of tungsten or molybdenum. The heating element is of vertically serpentine configuration in that it forms alternating upper and lower bends or bight portions 64, 66 (FIG. 3) which interconnect vertical segments 67 of the strip. The upper and lower bight portions 64, 66 each have a hole 68, 70 respectively, extending therethrough. The upper holes 68 are adapted to receive the support pins 60 such that the heating element 62 is suspended therefrom.

Located on opposite sides of each upper bight portion 64 are a pair of upper washers 72 formed of electrically insulative material such as alumina or yttria for example. The washers 72 serve as abutment members with the upper bight portions 64 sandwiched therebetween to prevent the heating element 62 from contacting (and thus shorting-out against) either of the shells 40, 42. The washers 72 can be secured to the support pins 60 in any suitable manner, such as by a conventional cotter pin arrangement (not shown), whereby cotter pins are inserted through the support pins 60 adjacent outside faces of the washers 72 to prevent removal of the washers 72 from the support pin. This also serves to position the heating element 62 relative to the support pins 60.

In lieu of using washers, the heating element can be mounted to the support pins 60, such as by grooves provided in the pins 60, whereby the sides of the groove function as abutments to constrain the heating element 62.

The lower bight portions 66 of the heating element are arranged for unconstrained thermal expansion relative to the shells in both upward and downward directions. That is, thermal expansion of the heating element is not constrained by any stop members mounted to the shells.

In order to space the lower bight portions 66 from the walls of the shells 40, 42 spacer assemblies 80 are supported by such bight portions. The spacer assemblies each comprises a lower pin 82 extending through the hole 70 in the respective lower bight portions and prejecting beyond the sides of the latter. A pair of lower washers 84 are mounted on the lower pin 82 on opposite sides of the lower bight portion to connect the lower pins 84 to the heating element. The lower pins 82 and washers 84 are formed of electrically insulative material, such as alumina or yttria for example, and the lower washers are secured in place in the same manner as described in connection with the upper washers 72.

In lieu of spacer members being carried by the heating element, spacer elements can be mounted to the shells 40, 42. For example, rings of electrically insulative material can be attached to the shells 40, 42, defining an annular slot therebetween into which the lower bight portions 66 extend.

It will be appreciated that the heating unit 46, including the heating element 62, the upper pins 60, upper washers 72, lower pins 82 and lower washers 84, can be assembled together and handled as a one-piece structure and simply lowered into the heater space 44 between the shells 40, 42 until the pins 60 rest upon the upper edges 54, 56 of the shells 40, 42.

If desired, the upper edges 54, 56 may each include slots or recesses 89 (see broken lines in FIG. 4) in which the support pins can be lowered, to positively resist circumferential displacement of the pins along the edges 54, 56.

Figure 5:
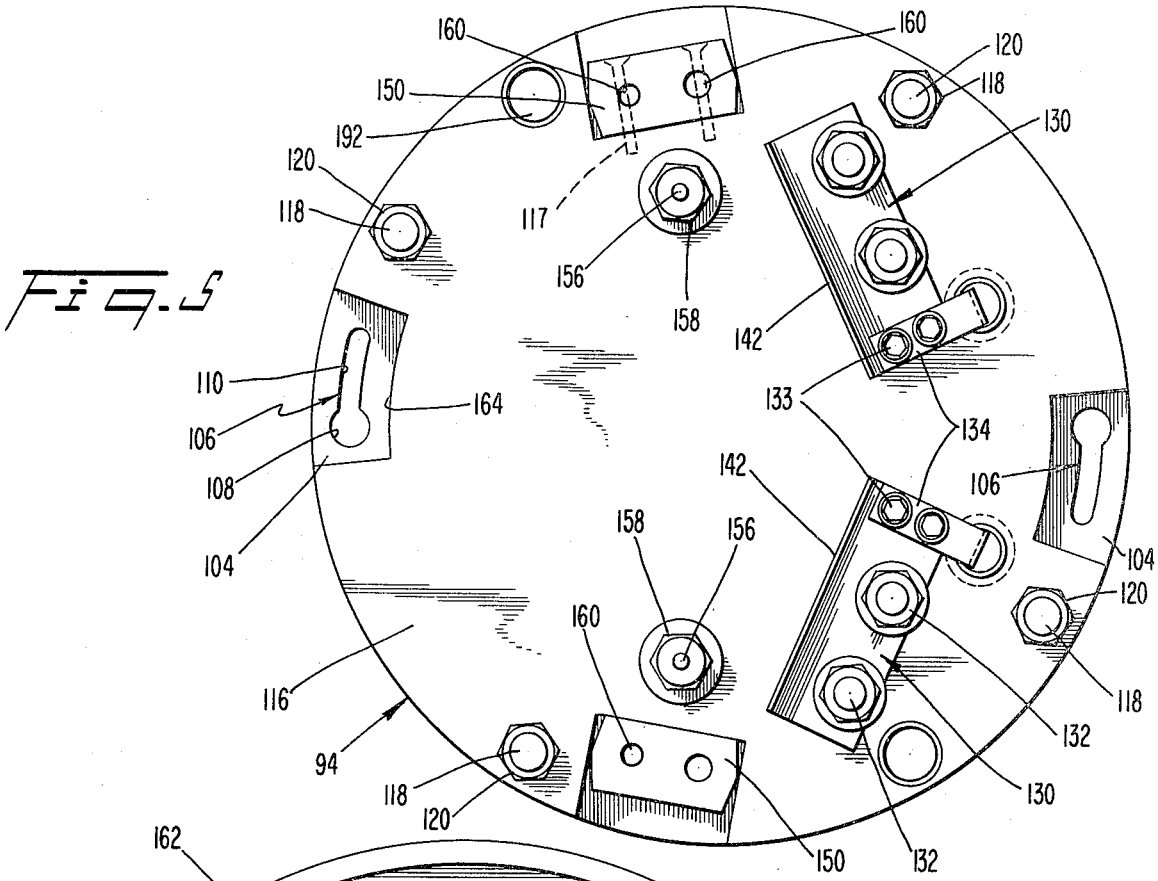
FIG. 5 is a plan view of a lower thermal barrier according to the invention.

The shells 40, 42 are supported within an annular groove 90 in a support plate 92, the latter being seated on a lower thermal barrier assembly 94 (FIGS. 1 and 5) which forms a portion of the furnace assembly 14. The lower thermal barrier assembly includes heat insulation assembly 96 which can be of any suitable arrangement for minimizing heat transfer.

Surrounding the insulation assembly 96 is an attachment ring 104. The ring 104 is formed of a suitable metal and is welded to a portion of the insulation assembly. The ring 104 includes a pair of slots 106 extending completely therethrough and including an enlarged portion 108 and a narrow portion 110. The slots 106 are each adapted to receive a bolt 112 which projects downwardly from the support ring 36 such that the head 114 of the bolt fits through the enlarged portion 108 of the slot 106. In this fashion the attachment ring 104 can be rotated until the head 114 underlies the narrow portion 10 of the slot to couple the support ring 36 to the attachment ring.

The lower thermal barrier assembly further includes a bottom plate 116 formed of an electrically insulative material such as Transite for example. The bottom plate 116 includes a plurality of holes which receive threaded studs 118 that depend from the attachment ring 104. Nuts 120 are secured to the studs 118 to secure the bottom plate 116 in place.

The bottom plate carries a plurality of electrical terminal members 130 which are secured in place by bolts 132.

Connected to each of the terminal members 130 via screws 133 is an electrical extension strip 134 which is secured to one end 136 of the heating element 62 via fasteners through holes 138 in the heating element. The extension strips 134 project through electrically insulated passages 140 formed in the insulation assembly 96 and the bottom plate 116.

Figure 6:
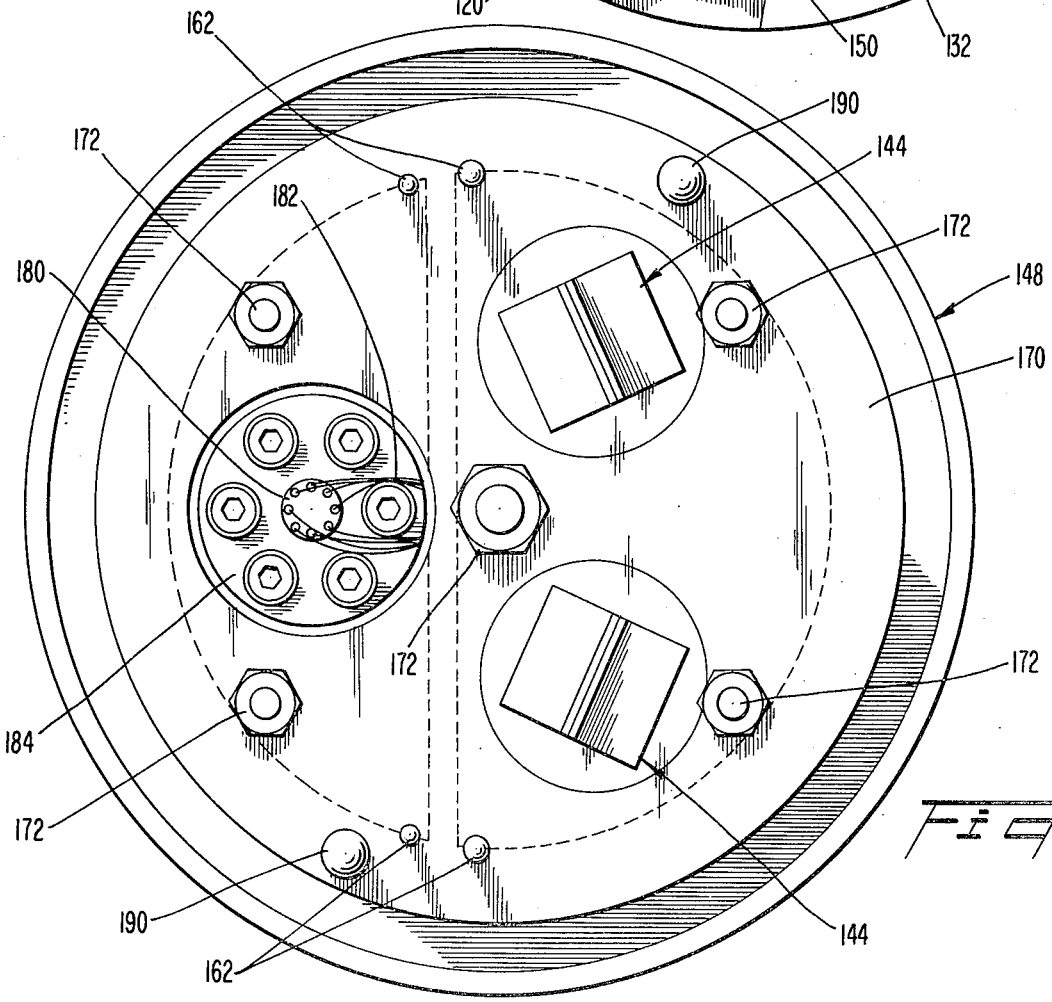
FIG. 6 is a plan view of an electrical adapter according to the present invention.

The terminal members 130 each include a depending leg 142 which is adapted to make electrical connection with an electrical connector clip 144 of an electrical adapter 148 (FIGS. 1 and 6) as will be discussed subsequently.

Mounted on the bottom plate 116 via screws 117 are a pair of thermocouple jacks 150. The jacks 150 are electrically connected to thermocouples 152 located in a work chamber 154, defined by the inner shell 40, by means of wires (not shown) which extend through passages 156 defined by bolts 158 mounted in the bottom plate 116. The jacks 150 each include a pair of openings 160 which are adapted to receive connector pins 162 carried by the adapter 148 (FIGS. 1 and 6) as will be discussed.

The bottom plate 116 also includes slots 164 along its outer periphery to accommodate insertion of the bolt heads 114 through the slots 106 in the attachment ring 104.

The adapter 148 includes an adapter plate 170 formed of electrically insulative material such as Transite. The adapter plate 170 carries a plurality of upwardly extending support studs 172 which engage and support the bottom plate 116.

Mounted on the adapter plate 170 in any suitable fashion is the pair of connector clips 144. Such clips are adapted to receive the legs 142 of the terminal members 130 to effect electrical connection of the heating element 62 with a source of electrical power, the lead lines of which (not shown) extend through a lower closure 174 and are connected to the clips 144.

Lead lines from the thermocouple pins 162 and from various thermocouples (not shown) in other areas of the furnace are connected to a central terminal assembly 180 on the adapter plate. Lines 182 extend from the terminal assembly 180 through an opening in the adapter plate which is covered by a cover plate 184 and travel through the lower closure 174 to a conventional main control panel (not shown) where temperatures within the furnace are monitored.

A plurality of alignment pins 190 project upwardly from the adapter plate 170 and are received in holes 192 in the bottom plate of the lower thermal barrier assembly to assure that proper orientation exists between the various components of the latter and the adapter 148 when the furnace is assembled.

The bottom closure 174 is threadedly secured to the outer pressure wall 12 to support the adaptor 148.

In assembling the furnace, the heating module 38, the main thermal barrier 24, the lower thermal barrier assembly 94, and the adapter 148 are each assembled separately. The support plate 92, together with a pedestal assembly 200 located within the work chamber 154, is positioned on the lower thermal barrier assembly 94; the shells 40, 42 are then arranged on the support plate 92; and the heating unit 46 is then laid upon the shells 40, 42. Initially, the extension strips 134 attached to the ends of the heating element are straight, rather than bent as shown in FIG. 1. Thereafter, the strips 134 are bent to make electrical connection with the terminal members 130.

The main thermal barrier 24 is welded to the support ring 36, and the latter is secured to the attachment ring 104 of the lower thermal barrier 94 via the bolts 112.

Accordingly, by lifting the main thermal barrier 24, the furnace assembly 14 can be raised.

The adapter 148 and lower closure 174 are installed at the lower end of the main pressure wall 12. Thereafter, the furnace assembly 14 is raised and lowered into the top of the pressure wall 12 and onto the adapter. Finally, the upper closure 18 is installed.

In FIG. 7 there is schematically depicted a standard pressure, temperature system for a hot isostatic pressure furnace. Gas is pumped from the storage containers 202 through compressors 204 into the pressure vessel via the bottom closure 174. Power is supplied to the furnace through SCR-type devices and controlled on the basis of inputs from the furnace and workload thermocouples.

In use of the high pressure furnace 10, work material is positioned on the pedestal assembly 200. The work material may comprise solid elements which are to be joined together, or a quantity of powderous or grannular material which is to be united to form a solid element. The work chamber is then pressurized and heated to effect the necessary uniting of materials.

While the present invention has been disclosed in connection with a hot isostatic pressure furnace, it is to be understood that the invention is applicable as well to other types of furnaces which act on work material and which do not operate under high pressures, such as vacuum furnaces for example.

It will be appreciated that the heating element is easily assembled and installed within the furnace assembly. That is, there are no insulators or hangers or the like which must be connected and disconnected from the inner shell 40. Rather, the heating element 62 is connected to the support pins 60, the spacer pins 82 are mounted on the heating element, and the washers 72, 84 are mounted on the pins 60, 82 respectively, thereby forming a one-piece structure which can be lowered into the space 44 between the shells 40, 42. Since the support pins 60 are supported at both ends on both shells 40, 42, the shells 40, 42 can each be made of extremely thin sheet metal which is easily rolled by hand. The combined thickness of the shells can be made less than the thickness of a single heater-support shell employed in some previously proposed furnaces. Thus, the non-critical space within the furnace assembly is reduced.

The heating element is capable of unconstrained thermal expansion and contraction. There is no need for concern about breakage of the heating element upon excessive contraction. Moreover, it is assured that the heating element will not contact and short-out against either of the shells, due to the presence of spacers at upper and lower ends of the heating element.

The heating element is of flattened strip shape, thus increasing the area of heat dissipation and is spaced from the adjacent shell walls to maximize heat transfer.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

I claim:

1. A furnace for heating work material, comprising:

an outer wall enclosing a space;

a first upright cylindrical shell disposed within said space and defining a work chamber for receiving work material to be heated;

a second upright cylindrical shell surrounding and spaced outwardly of said first shell to form a heater space therebetween, heater means comprising:

support means disposed across and supported atop said first and second shells, said support means comprising a plurality of circumferentially spaced radially extending pins formed of electrically insulative material, each pin being seated on upper edges of said first and second shells;

generally vertically extending electrical heating element means supported from said pins and disposed within said heating space and extending around at least a portion of the periphery of said first shell, said heating element means being unconstrained against free thermal expansion and contraction in vertical directions relative to said first and second shells, said electrical heating element means comprising a vertically serpentine element including upper and lower bight portions, said upper bight portions being carried by said pins.

2. Apparatus according to claim 1 wherein said support means further comprises abutment means formed of electrically insulative material and mounted on each pin on opposite sides of an associated upper bight portion to retain the latter in place.

3. Apparatus according to claim 2 wherein said abutment means comprises a pair of washers.

4. Apparatus according to claim 1 including electrically insulative spacer means disposed within said heater space for preventing contact of a lower end of said heating element means with said first and second shells.

5. Apparatus according to claim 4 wherein said spacer means is supported on said heating element means.

6. Apparatus according to claim 5 wherein said heating element means comprises a vertically serpentine element including upper and lower bight portions, said upper bight portions being carried by said support means, said spacer means comprising a plurality of pins mounted in holes in said lower bight portions and extending beyond the ends of said holes.

7. Apparatus according to claim 6 wherein said spacer means further includes abutment means formed of electrically insulative material and mounted on said pins on opposite sides of said lower bight portions.

8. Apparatus according to claim 1 wherein said outer wall comprises a pressure vessel, and further including means for introducing a pressurizing medium into said furnace.

9. Apparatus according to claim 1 wherein said outer wall comprises a thermal barrier.

10. Apparatus according to claim 1 wherein said shells are each of circular cross-section.

11. A furnace of the type for heating work material, comprising:

an outer wall enclosing a space;

a first upright cylindrical shell disposed in said space and defining therein a work chamber for receiving work material to be heated, a second upright cylindrical shell surrounding and spaced outwardly of said first shell to define a heater space therebetween, and heater means comprising:

a heating element formed of a generally flat strip of electrically conductive material and oriented in vertically serpentine fashion within said heating space and extending around at least a portion of the periphery of said first shell, said heating element including upper bight portions supported on both of said first and second shells, and lower bight portions constrained against free thermal expansion and contraction in vertical directions relative to said first and second shells, and electrically insulative spacer means supported by said heating element and disposed within said heater space to prevent contact between electrically conductive portions of said heating element and said first and second shells.

12. Apparatus according to claim 11 wherein said spacer means comprises pins carried by said lower bight portions.

13. Apparatus according to claim 11 wherein said heating element is supported from the upper edges of both of said first and second shells.

14. Apparatus according to claim 13 including a plurality of circumferentially spaced radially extending support pins extending across said upper edges of said first and second shells, said upper bight portions of said heating element being connected to said pins.

15. Apparatus according to claim 11 including means for introducing a pressurized medium into said furnace.

16. Apparatus according to claim 11 wherein said outer wall comprises a pressure wall, and further including a thermal barrier located between said second shell and said pressure wall.

17. Apparatus according to claim 11 wherein said outer wall comprises a thermal barrier.

18. A hot isostatic pressure furnace comprising:

cylindrical outer pressure wall means enclosing a furnace space, a first cylindrical shell disposed within said furnace space and defining therewithin a work chamber for receiving work material to be heated, thermal insulating sheath means disposed between said first shell and said outer wall means to resist the escape of heat, a second cylindrical shell surrounding said first shell and spaced radially outwardly thereof to form a heater space therebetween, a heater assembly mounted on said first and second shells and comprising:

a plurality of radially extending, circumferentially spaced upper pins formed of electrically insulative material and extending across upper edges of both of said first and second shells, a pair of upper washers mounted on each of said upper pins and formed of electrically insulative material, an electrically conductive heating element of vertically serpentine configuration forming upper and lower bight portions, said upper bight portions disposed between said upper washers and including holes receiving said upper pins to suspend said heating element from said upper pins, said heating element extending around the outer periphery of said first shell and formed of flat strip material of rectangular cross-section, a plurality of radially extending circumferentially spaced lower pins formed of electrically insulative material supported in holes in said lower bight portions, and a pair of lower washers mounted on each of said lower pins externally of said lower bight portions to retain the latter in place, said heating element being unconstrained against free thermal expansion and contraction in vertical directions relative to said first and second shells.

19. A furnace for heating work material, comprising:

an outer wall enclosing a space;

a first upright cylindrical shell disposed within said space and defining a work chamber for receiving work material to be heated;

a second upright cylindrical shell surrounding and spaced outwardly of said first shell to form a heater space therebetween, said first and second shells each including an upper edge having slots therein; and heating means comprising:

support means disposed across and supported atop said first and second shells, said support means comprising a plurality of circumferentially spaced radially extending pins formed of electrically insulative material, each pin being seated on upper edges of said first and second shells;

generally vertically extending electrical heating element means supported from said pins and disposed within said heating space and extending around at least a portion of the periphery of said first shell, said heating element means being unconstrained against free thermal expansion and contraction in vertical directions relative to said first and second shells.

* * * * *